US005085442A

United States Patent [19]

Lee

[11] Patent Number: 5,085,442

[45] Date of Patent: Feb. 4, 1992

[54] ARTICLES OF PLAY FOR USE IN THE GAME OF CATCH

[75] Inventor: Miryoung Lee, West Covina, Calif.

[73] Assignee: Many Amazing Ideas, Walnut, Calif.

[21] Appl. No.: 642,278

[22] Filed: Jan. 15, 1991

Related U.S. Application Data

[63] Continuation-in-part of Ser. No. 490,301, Mar. 8, 1990, Pat. No. 4,995,617.

[51] Int. Cl.[5] ..... A63B 67/00

[52] U.S. Cl. ..... 273/346; 273/412; 273/DIG. 30

[58] Field of Search ..... 273/346, 412, 58 A, 273/DIG. 19, DIG. 24, DIG. 30

[56] References Cited

U.S. PATENT DOCUMENTS

| | | | |
|---|---|---|---|
| 716,645 | 12/1902 | Ransom | 273/DIG. 24 X |
| 3,032,345 | 5/1962 | Lemelson | 273/346 |
| 3,601,406 | 8/1971 | Glass | 273/DIG. 30 X |
| 3,857,566 | 12/1974 | Lemelson et al. | 273/346 |
| 3,917,271 | 11/1975 | Lemelson et al. | 273/346 |
| 3,927,881 | 12/1975 | Lemelson et al. | 273/58 K |
| 3,999,748 | 12/1976 | Clarke | 273/346 |
| 4,017,076 | 4/1977 | Bai | 273/346 |
| 4,789,161 | 12/1988 | Waskeld | 273/327 |
| 4,995,617 | 2/1991 | Lee | 273/346 |
| 5,066,017 | 11/1991 | Kurland | 273/344 |

FOREIGN PATENT DOCUMENTS

| | | | |
|---|---|---|---|
| 59911 | 1/1986 | Rep. of Korea | 273/346 |
| 22590 | 12/1989 | Rep. of Korea | 273/346 |

*Primary Examiner*—William H. Grieb

*Attorney, Agent, or Firm*—Lieberman Rudolph & Nowak

[57] ABSTRACT

Articles of play for use with the game of catch including a ball covered with VELCRO and a multi-layer catcher's mitt with a front layer also covered in mating VELCRO like material. The multi-layer mitt includes a rigid concave rear layer, a first intermediate flexible layer, a second intermediate flexible layer, and said front layer of VELCRO.

17 Claims, 8 Drawing Sheets

FIG.5A
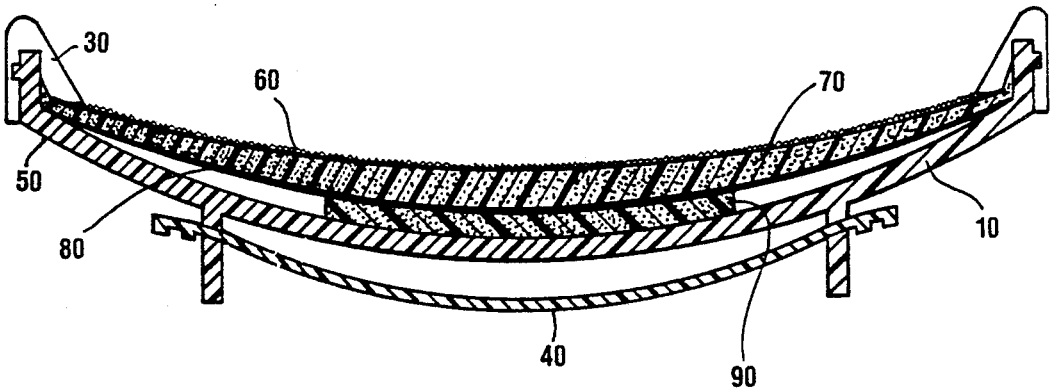
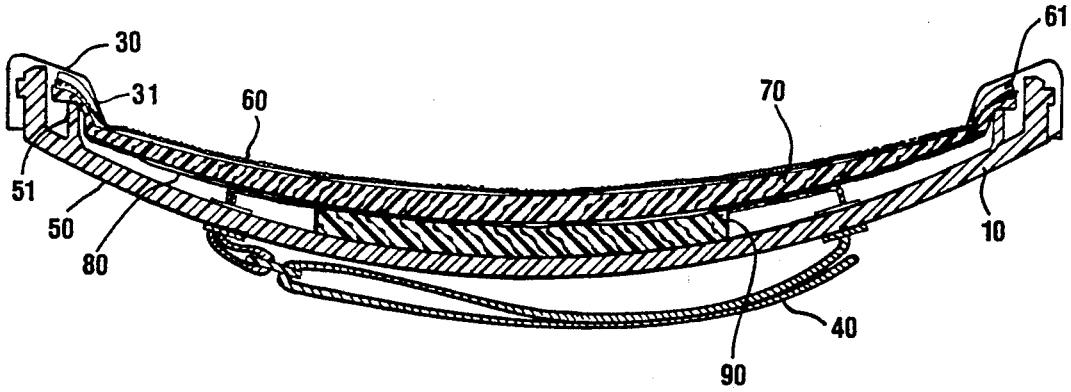
FIG.5B

FIG. 8
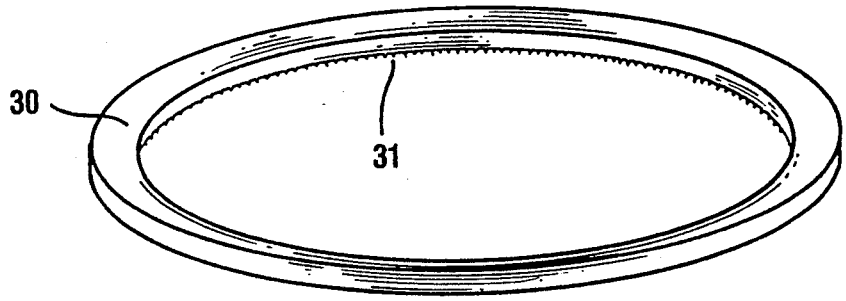
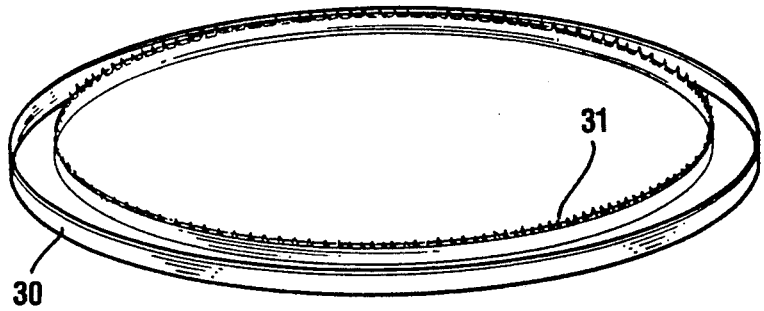
FIG.9

ARTICLES OF PLAY FOR USE IN THE GAME OF CATCH

FIELD OF THE INVENTION

This application is a continuation-in-part of U.S. Ser. No. 490,301, filed Mar. 8, 1990now U.S. Pat. No. 4,995,617issued Feb. 26, 1991, the contents of which are hereby incorporated by reference. This invention relates to articles of sport and play and, more particularly, to unique articles for playing the game of catch, which articles are particularly useful for use with young children, as well as adult players.

BACKGROUND OF THE INVENTION

The game of catch has been played since antiquity, both as a form of play and, in more recent times, as part of a sport such as baseball, etc. As is well known, the game is played by tossing a ball (or any similar article) back and forth between two or more players, which players may catch the ball with their bare hands, or with the aid of a baseball glove, or the like.

Although throwing and catching an object, such as a ball, is enjoyable and quite easy for older children or adults, a surprising amount of coordination is required to successfully play the game, which coordination is sometimes lacking in younger children still in the early stages of physical development. Therefore, although younger children are generally quite eager to attempt playing the game of catch or related sports activities, they may soon become frustrated in their efforts due to their inability to successfully catch the ball.

It is, therefore, an object of the instant invention to simplify the game of catch so that the game is easily played by younger children.

It is another object of the instant invention to simplify the game of catch by providing play articles which permit a young child to easily catch a thrown object, such as a ball, through use of a unique catching aid.

In accordance with one aspect and feature of the instant invention, unique play articles are provided for playing the game of catch, which play articles include a catcher's aid, such as a glove type article, with a front surface covered in a hook and loop type fastening material such a VELCRO (registered trademark of The Velcro Manufacturing Co.), along with a ball whose entire surface area may also be covered in similar material whereby the ball is easily caught by the catcher's glove due to the attachment action of the hook and loop type fastening material.

Prior art patents exist in which mating sections of VELCRO, or hook and loop fastening means material, are used to facilitate adherence of an object to the front surface of a play article.

One of the earliest of said patents is U.S. Pat. No. 3,032,345, issued on May 1, 1962 to Jerome H. Lemelson. The '345 Lemelson patent was directed to a dart game in which the front surface of the dart, and the front surface of the target, were covered with VELCRO material. Therefore, when the dart was thrown at the target, the dart would attach to the target, simulating play as with an actual game of darts, but without the danger of using steel tipped darts.

A second Lemelson patent, U.S. Pat. No. 3,857,566, was issued on Dec. 31, 1974, and is directed to solving the problem of the dart disengaging from the target area due to the inherent bounce of the dart upon impact on the target. The "bounce problem" was addressed in the '566 patent by stretching VELCRO material over a frame, which frame maintained a predetermined distance between the VELCRO material and the wall on which the frame was to be hung. Therefore, during the initial impact stage of the head of the dart against the flexible VELCRO material, the dart decelerates, without bounce, thereby preventing disengagement between the dart and the target.

Although the '566 patent addressed the "bounce problem", it did so by providing a frame structure over which the VELCRO material was stretched. Such a solution is clearly unsatisfactory for play articles to be used in the game of catch or other baseball like games.

A similar patent directed specifically to the game of catch is U.S. Pat. No. 3,999,748, issued to William A. Clarke on Dec. 28, 1976. This reference is directed to play articles useful in the game of catch, comprising a ball coated with hook and loop fastening means material, and a mitt or glove having an outer face also covered with a hook and loop fastening means material. The mitt or glove is a multi-layer device, consisting of a facing layer of VELCRO material, a flexible textile backing layer, and an intermediate plastic foam layer sandwiched between the backing layer and the facing layer. The entire multi-layer device is flexible in nature, without rigid parts, which construction, although not mentioned in the '748 patent, might tend to somewhat reduce the "bounce problem". However, it is clear that the flimsy construction of the mitt described in the '748 patent would prohibit any "hard thrown" balls due to inadequate padding and, moreover, the flexible nature of the entire glove would result in constant movement on the hand, which would make the glove very difficult for use with young children.

It is, therefore, an object of the instant invention to provide articles of play for use with the game of catch, which articles are somewhat rigid and, thus, easily used with young children, while at the same time completely eliminating the "bounce problem".

It is a further object of the instant invention to provide articles of play for use in the game of catch, which articles of play can be used with young children, but also capable of absorbing the high energy of hard thrown balls without bounce or injury to the hand and, therefore, is useful with adults as well as children.

Lastly, it is an object of the instant invention to provide a game of catch which is simple and economical to manufacture.

SUMMARY OF THE INVENTION

In accordance with a first aspect and feature of the instant invention, articles of play for use with the game of catch comprise a ball having at least a portion of its surface defined by a multitude of irregular filamentary formations, such as, for example, being provided by VELCRO material.

In accordance with another feature of the instant invention, a multi-layer mitt is provided for each participant in the game of catch, the mitt including a rigid concave rear layer, a first intermediate flexible layer, a second intermediate flexible layer, and a front layer having at least a portion of its front surface covered with a VELCRO material.

It is another feature of the invention that the adhesive qualities of the VELCRO material present both on the ball and the multi-layer mitt, permit the game of catch to be readily played by very young individuals lacking advanced physical coordination.

It is a still further feature of the invention that the use of said first and second intermediate flexible layers completely eliminate "bounce" when the ball strikes the mitt and also provides, in conjunction with the rigid rear layer, extensive hand protection, thereby allowing adults to play the game of catch wherein the ball can be thrown with great force and easily caught.

These and other objects and features of the invention will be more fully appreciated from the following detailed description when taken in conjunction with the accompanying drawings.

BRIEF DESCRIPTION OF THE DRAWINGS

FIG. 5A is a cross-sectional side view of an embodiment of the mitt used with the instant invention;

FIG. 5B is a cross-sectional side view of an second embodiment of the mitt used with the instant invention;

FIG. 8 is a perspective view of the top portion of a retaining ring; and

FIG. 9 is a perspective view of the bottom of a retaining ring.

DETAILED DESCRIPTION OF THE INVENTION

Figure 1:
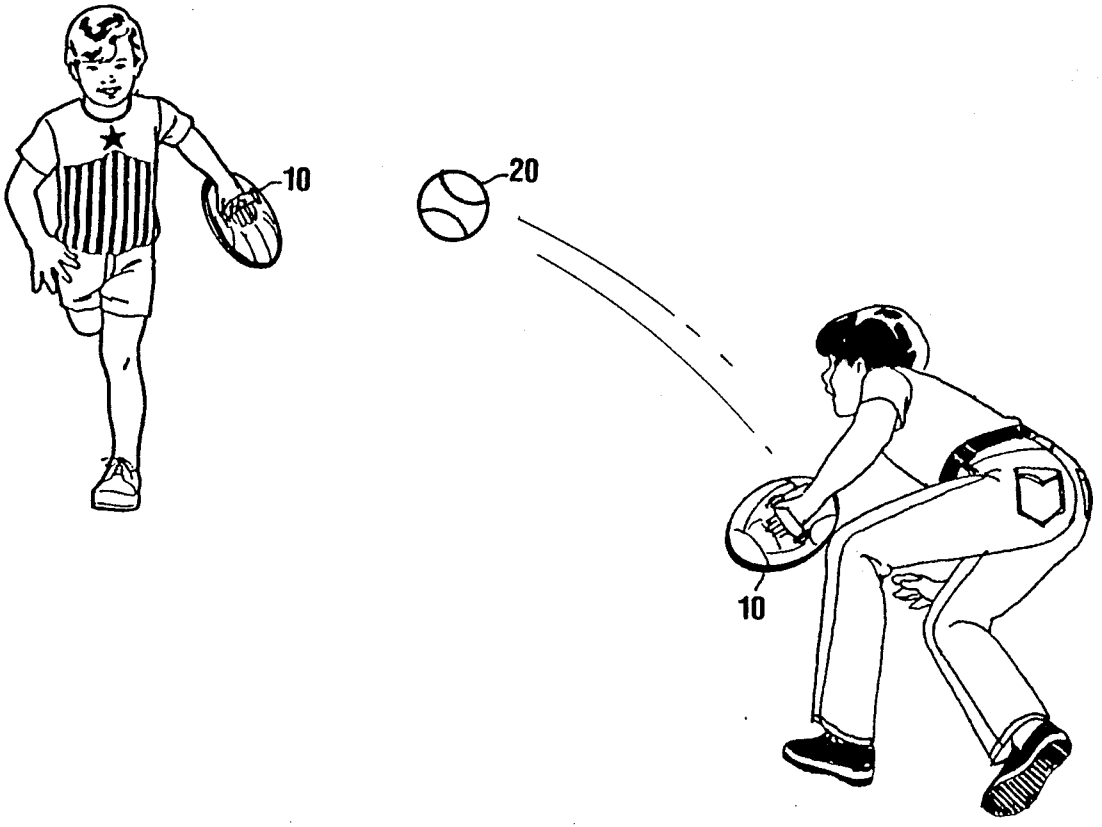
FIG. 1 illustrates use of the instant invention while being utilized by children for playing the game of catch.
Figure 2A:
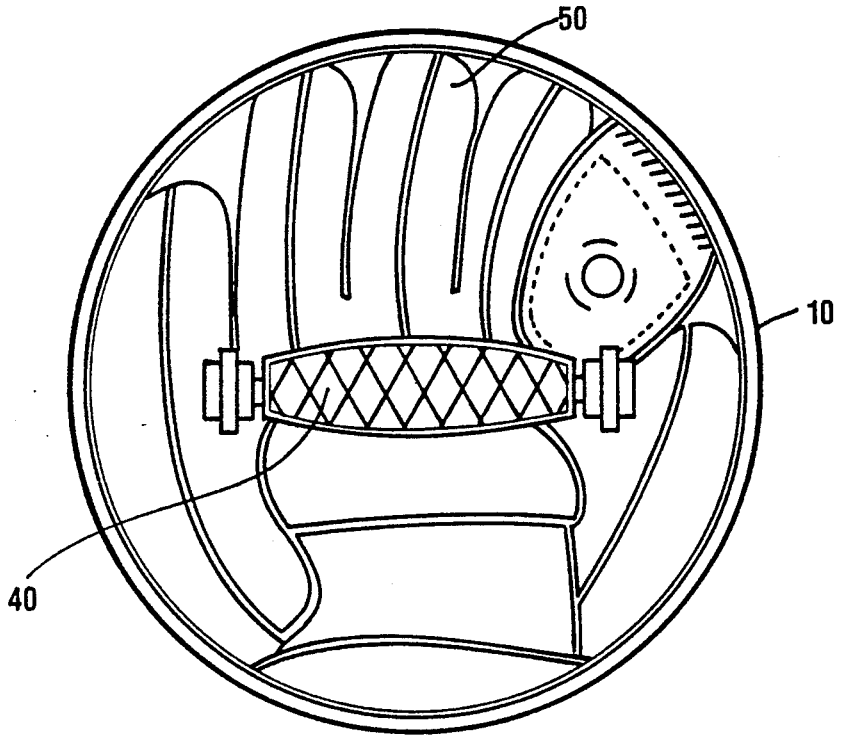
FIG. 2A is a rear view of a mitt used with the instant invention showing a non-adjustable handle.

Referring now to FIG. 1, there is shown two young children engaging in a game of catch, while using articles of play in accordance with the instant invention. Each child has on his left hand the "catcher's mitt" 10 which, as described above, has a front surface covered with a multitude of irregular filamentary formations such as VELCRO material. Ball 20 is also covered with a mating surface of irregular filamentary formations, such as VELCRO strips or, preferably, an entire VELCRO covering so that the ball will adhere to the catcher's mitt when thrown by each child.

FIGS. 2A, 2B and 3A, 3B illustrate a front and back view of the catcher's mitt. FIGS. 2A, 3A, 5A, and 7A refer to a first embodiment of the subject mitt and FIGS. 2B, 3B, 5B, 6, 7B, 8 and 9 refer to a second embodiment of the subject mitt. The rear layer 50 of the mitt is preferably made of a polyethylene material, which is very strong and makes the mitt nearly impossible to break under strong impacts. It is to be understood that the polyurethane material may have formed in the surface thereof the shape of an actual catcher's mitt or, of course, other shapes may be utilized.

Figure 3A:
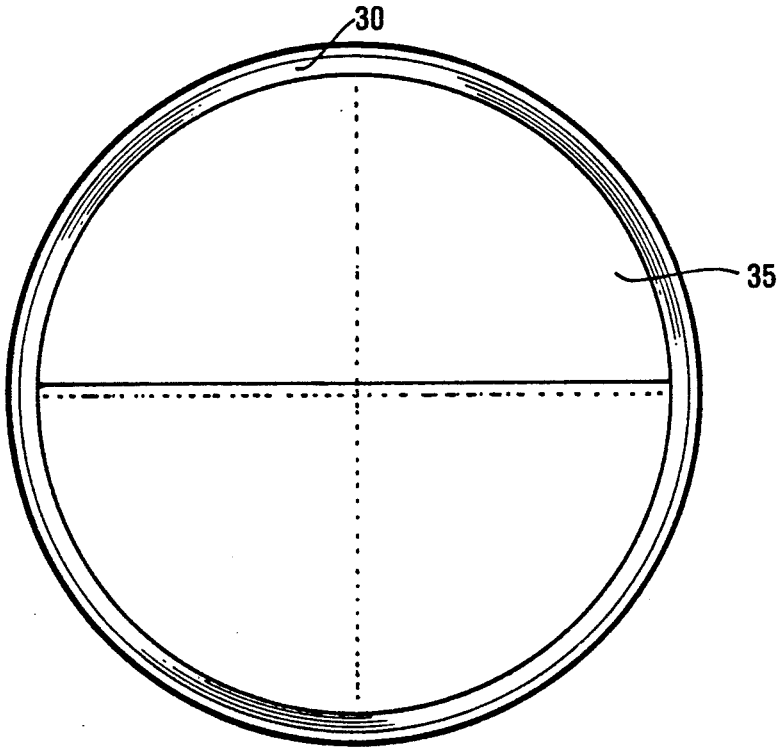
FIG. 3A is a front view of a mitt used with the instant invention.
Figure 2B:
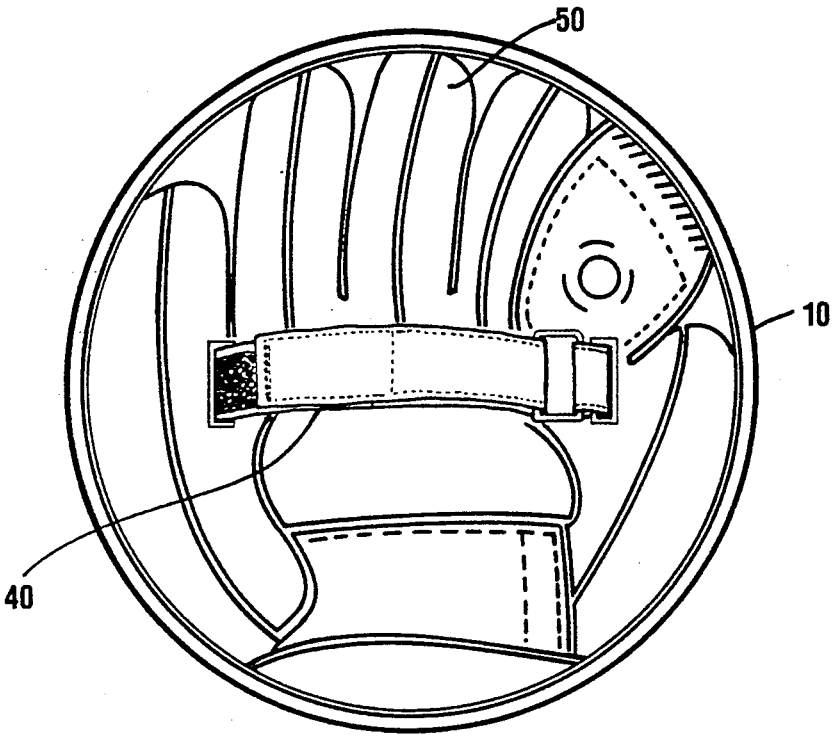
FIG. 2B is a rear view of a mitt used with the instant invention showing an adjustable handle.
Figure 3B:
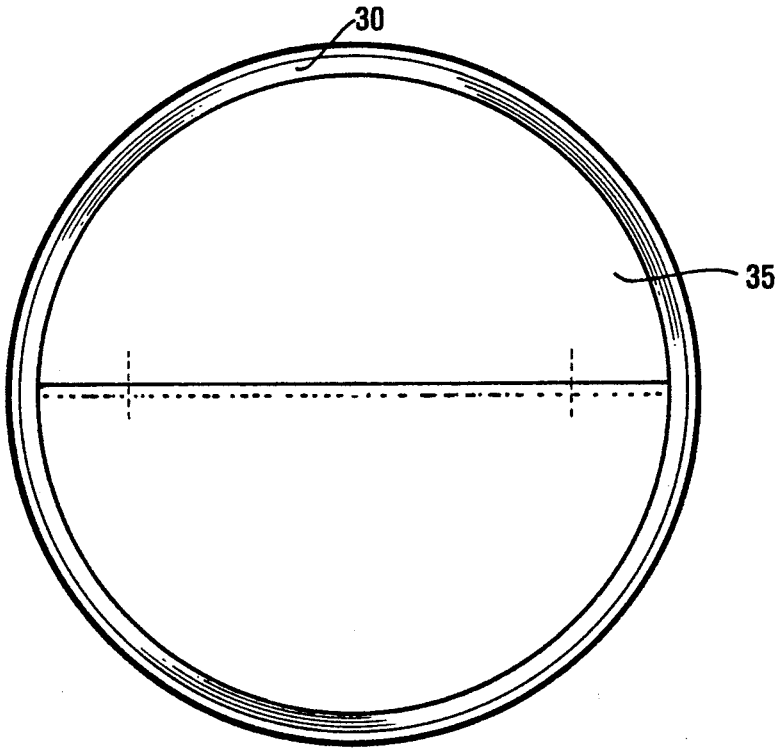
FIG. 3B is an alternative front view of a mitt used with the instant invention.

The player engages the mitt by inserting his, or her, hand under the handle 40. Preferably, the handle is adjustable to fit hands of various sizes. In a preferred embodiment, the handle comprises a strap which passes through the rigid rear layer and attaches to the cotton fabric layer 80 to further secure the VELCRO-cotton fabric layer in its center. The handle is typically adjusted by a VELCRO or other type closure. FIGS. 3A and 3B illustrate the front surface of the mitt which, as described above, has a covering of VELCRO at area 35 covering the entire surface of the mitt. The VELCRO covering is retained in place in a manner described below, with the edges of the VELCRO being restrained by retaining ring 30.

Figure 4A:
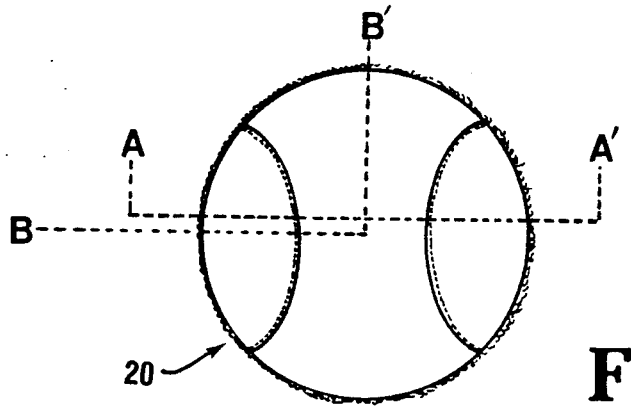
FIG. 4A is a front view of a ball used with instant invention.
Figure 4B:
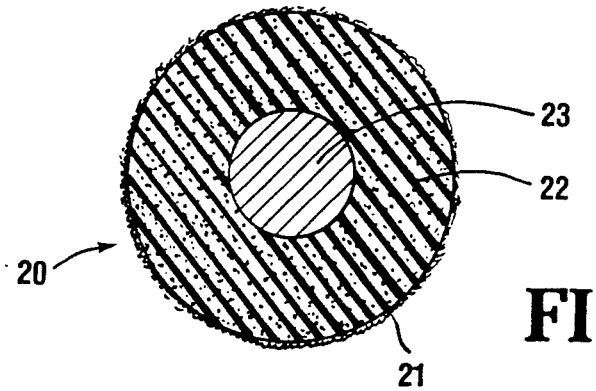
FIG. 4B is a cross-sectional view along line A—A' of a ball used with the subject invention showing a weighted center surrounded by a layer of foam.
Figure 4C:
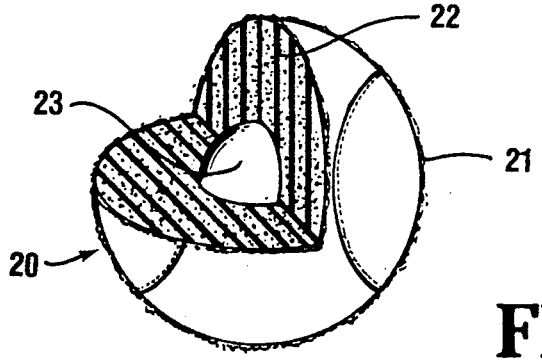
FIG. 4C is a cut-away view along line B—B' of a ball used with the subject invention wherein a semi-hemisphere has been removed while the weighted center has been left intact.

FIG. 4A illustrates a preferred embodiment of ball 20 having an outer surface 21 substantially covered with irregular filamentary formations, such as a nappy VELCRO surface. It is to be understood, however, that almost any type of ball having a surface covered with irregular filamentary formations may be utilized. This VELCRO type surface allows for adhesion of the ball to the front surface of the mitt. As illustrated in FIGS. 4B and 4C, the ball may contain a weighted center to provide ballast for increasing the distance that the ball can be thrown and for minimizing the effect of wind upon the ball. The weighted center 23 may be surrounded by any suitable material. However, it is preferred that the weighted center layer be surround by a foam layer 22.

FIG. 5A and 5B illustrate cross-sectional side view of the mitt. As described, ball 20 is completely covered with a VELCRO layer for adhesion to the VELCRO front surface of the catcher's mitt. The VELCRO front surface consists of a layer of VELCRO material 60 behind which is inserted a foam layer 70, preferably of a thickness approximating one-third inch, which foam layer is backed by a cotton fabric layer 80. It is to be understood, however, that any suitable fabric may be employed. For example, fabrics such as nylon, polyester or silk may be utilized instead of cotton. Beneath the cotton fabric layer 80 is a second flexible foam layer 90, which preferably occupies an area approximately 3.5 inches square, and is arranged to lie within the approximate center of the catcher's mitt. The foam material utilized for both layer 90 and layer 70 is preferably a polyurethane foam. It is, of course, understood that layers 70 and 90 could be combined into a single foam layer. The total distance between layer 60 and the rear layer 50 of the mitt, is typically in the range of between about one-fourth and about two inches. Similarly, if the mitt is circular, its diameter is typically between about six and about twelve inches.

The second embodiment of the subject invention (depicted in FIGS. 2B, 3B, 5B, 6, 7B, 8 and 9) shows the preferred manufacture of the subject invention. In this embodiment, the mitt 10 is constructed so as to eliminate the use of glue to adhere the layers both to each other and to the rigid rear layer 50. This improvement results in a substantial savings in both time and material over the construction described in the parent patent application, U.S. Ser. No. 490,301, filed Mar. 8, 1990.

In the second embodiment, foam layer 90, fabric layer 80, foam layer 70 and VELCRO layer 60 are stacked in the rigid rear layer 50 of mitt 10. The layers may optionally be sewn to handle 40 to support them in place. Most preferably, the handle is an adjustable strap which loops above foam layer 90 thereby holding it in place. Fabric layer 80, foam layer 70 and VELCRO layer 60 are then sewn to the handle.

The layers of mitt 10 are held in place by retaining ring 30. Preferably, retaining ring 30 has a plurality of teeth 31 which grip VELCRO layer 60 securely. To further assist the retaining ring in securing the layers in place, rigid rear layer 50 has a plurality of raised protrusions 51 that are preferably arranged in a pattern conforming to that of the inner edge of retaining ring 30, but defining a slightly larger perimeter. For example, if the inner edge of retaining ring 30 is circular and has a radius of three and one-quarter inches, then the arrangement of raised protrusions 51 is also circular with the inner edge of the raised protrusions 51 defining a radius of three and three-eights inches. By having this configuration, the layers are further secured between the inner edges of retaining ring 30 and the raised protrusions 51.

To further aid in securing the layers, nappy VELCRO strips 61 may be attached to the perimeter of VELCRO layer 60. Preferably, these nappy VELCRO strips 61 are of a width that fits between the inner edge of the retaining ring and the edge of the rigid rear layer 50.

Accordingly, the preferred method of manufacture comprises the steps of:

(a) placing foam layer 90 into the concave portion of rigid rear layer 50;

(b) attaching handle 40 through the openings in rigid rear layer 50 so that the handle passes over foam layer 90;

(c) placing fabric layer 80 on top of handle 40 and foam layer 90;

(d) placing foam layer 70 on top of fabric layer 80;

(e) placing VELCRO layer 60 on top of foam layer 70;

(f) sewing layers 80, 70, and 60 to handle 40;

(g) attaching nappy VELCRO strips 61 to the periphery of VELCRO layer 60; and (h) snapping retaining ring 30 upon the top of VELCRO layer 60 and onto the rigid rear layer 50 so as to secure all the layers to the rigid rear layer 50 thereby forming mitt 10.

It should be noted that the above method of manufacture is only a guideline and that various steps may be combined or carried out in a different order. For example, steps c, d, e and f may be combined i.e., fabric layer 80, foam layer 70 VELCRO strip 61 may be combined and attached as a single unit after step b. Also as an example, step g may occur before step f.

An alternative method of construction includes layer 9 being glued to rear layer 50 of mitt 10 and, thereafter, gluing cotton fabric layer 80 over layer 90, and also gluing layer 80 to the rear layer 50 of mitt 10. Foam layer 70 is sewed to cotton layer 80 and, thereafter, VELCRO layer 60 is sewed to foam layer 70. Use of the cotton fabric substantially prevents the foam layers from separation, and makes the foam layers much more durable under repeated impacts from ball 20.

Figure 6:
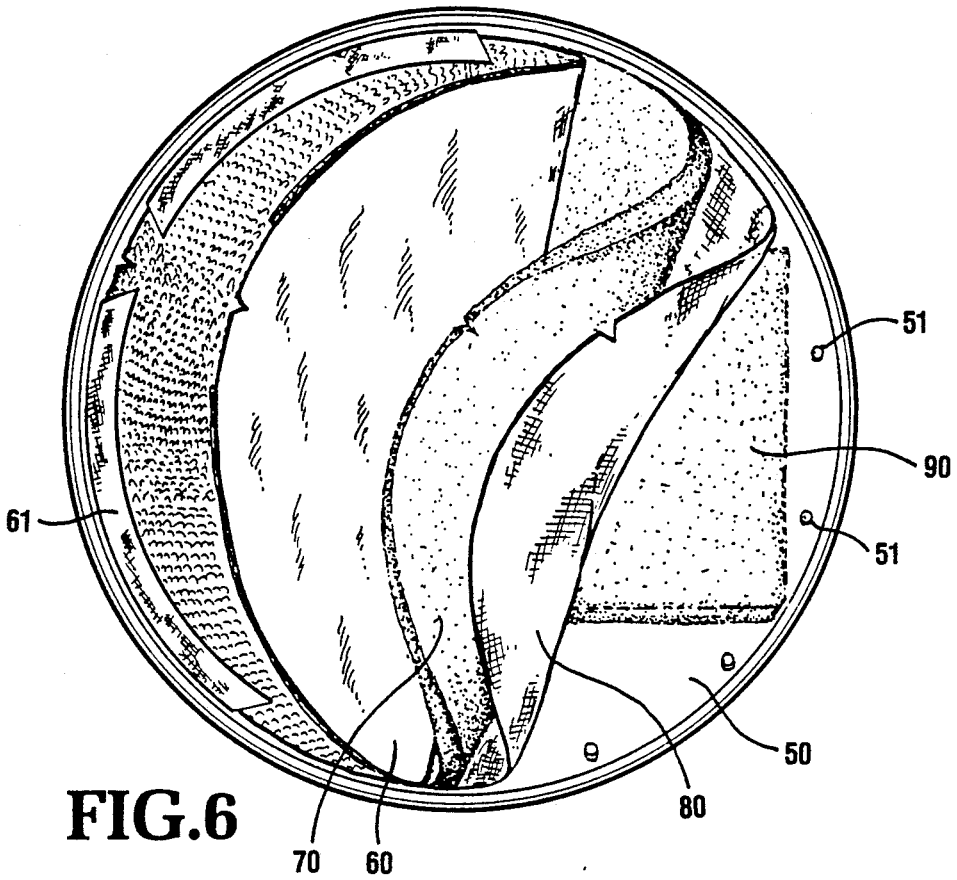
FIG. 6 is a top view of a mitt used with the instant invention wherein the layers of VELCRO, foam, cloth, and foam have been exposed.

FIG. 6 illustrates a top view of a mitt in which the layers of VELCRO 60, foam 70, cloth 80 and foam 90 have been exposed. Around the inner circumference of the rigid rear layer 50 is a series of raised protrusions 51 which aid in holding the upper cloth, foam and VELCRO layers in place.

Figure 7A:
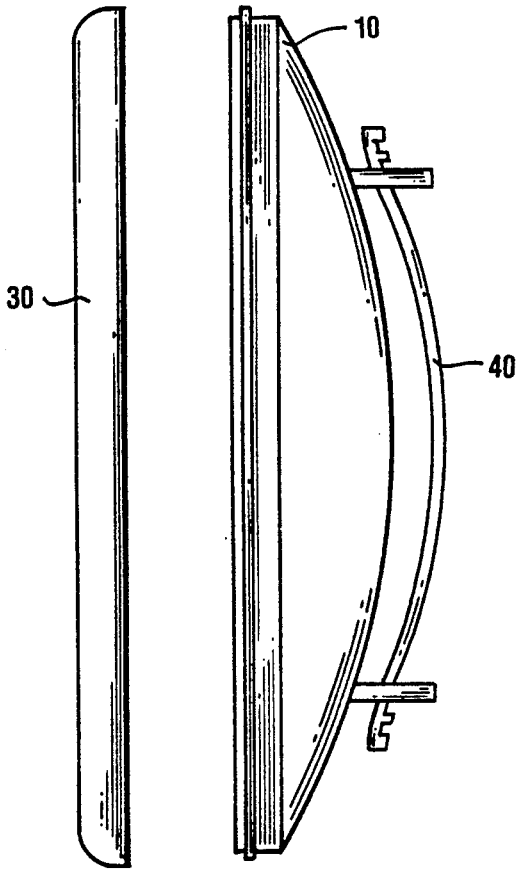
FIG. 7A is a side view of an embodiment of the mitt of the instant invention showing the retaining ring removed.
Figure 7B:
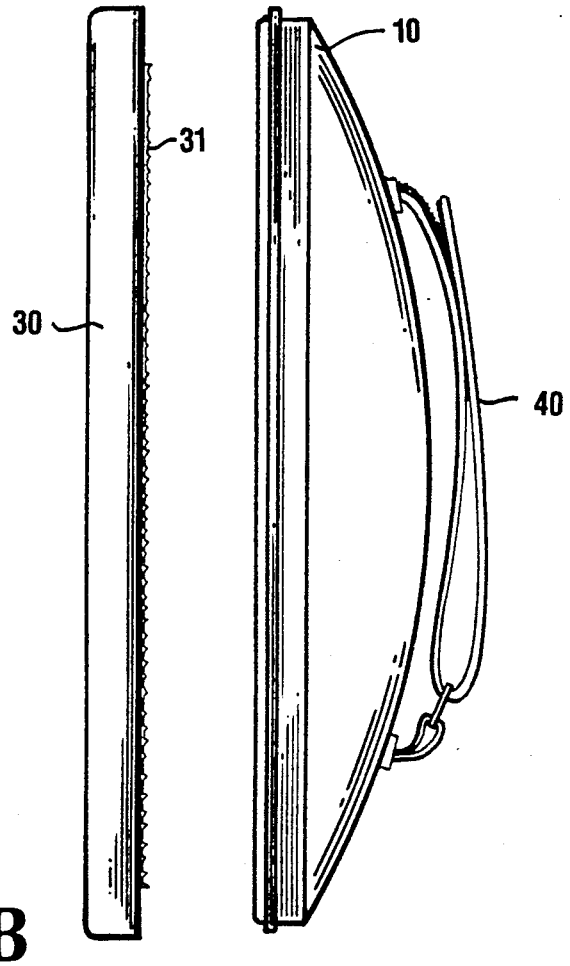
FIG. 7B is a side view of a second embodiment of the mitt of the instant invention showing the retaining ring removed.

FIGS. 7A and 7B illustrate side views of the catcher's mitt illustrating handle 40, mitt 10 and retaining ring 30. The purpose of retaining ring 30 is to ensure that the VELCRO layer does not separate when ball 20 is removed from mitt 10. The preferred retaining ring 30 (See FIGS. 7B, 8 and 9) has a plurality of teeth 31 which are on the portion of the ring that contacts the VELCRO layer. These teeth function to further secure the VELCRO layer.

In the preferred embodiment a series of nappy VELCRO strips 61 are affixed to the perimeter of the VELCRO layer 60 to augment the holding ability of the retaining ring 30.

It should also be understood that various portions of the mitt or ball may be made of various colors, and/or made of phosphorescent material for exciting night-time play.

The advantage of the instant invention is the use of foam layers 70 and/or 90, which layer, or layers, are designed to substantially absorb any impact by the ball during the game of catch, and thus prevent disengagement between the ball and the mitt. Due to the fact that the foam layer(s) absorb approximately 60% of the impact of the ball, the ball will consistently adhere to the VELCRO front layer of the catcher's mitt, thereby insuring a successful game of catch for young children and other relatively uncoordinated individuals.

In addition, the foam layer(s) completely eliminate any "bounce problem", as well as providing adequate hand protection so that the inventive articles of play can accommodate hard thrown balls fielded by adult players.

The foregoing disclosure and description of the invention is illustrative and explanatory thereof and various changes in the size, shape and materials, as well as in the details of the illustrated constructions, may be made within the scope of the appended claims without departing from the spirit in the invention.

What is claimed is:

1. Articles of play or sport, for use with the game of catch, comprising:

(a) a missile having substantially all of its surface defined by a multitude of irregular filamentary formations, and (b) a multi-layer mitt for use by a participant in the game of catching said missile, said multi-layer mitt including a rigid concave rear layer, a first intermediate flexible layer, a second intermediate flexible layer, and a front layer having substantially all of its front surface defined by a multitude of irregular filamentary formations, said first intermediate flexible layer occupying a surface area less than the surface area of said rear layer, and said second intermediate flexible layer occupying a surface area substantially equal to the surface area of said rear layer, said front layer being retained in place by a retaining ring having an inner edge, the inner edge including a plurality of teeth which contact a portion of said front layer, to prevent said front layer from separating from said second intermediate flexible layer.

2. Articles of play or sport, in accordance with claim 1, wherein said multi-layer mitt has means incorporated into said concave rear layer for enabling each participant in the game of catch to grab said mitt in one of said participant's hands.

3. Articles of play or sport, in accordance with claim 2, wherein the means for enabling each participant to grab said mitt comprises a strap.

4. Articles of play or sport, in accordance with claim 3, wherein the strap is adjustable.

5. Articles of play or sport, in accordance with claim 4, wherein the strap is adjusted using a multitude of interlocking filamentary formations.

6. Articles of play or sport, in accordance with claim 3, wherein the strap is attached to the mitt by passing through a void in the rigid concave rear layer.

7. Articles of play or sport, in accordance with claim 6, wherein the strap passes through a void in the rigid concave rear layer and is further anchored to the front layer.

8. Articles of play or sport, in accordance with claim 1, wherein said first and second intermediate layers are comprised of polyurethane foam.

9. Articles of play or sport, in accordance with claim 1, wherein the distance between said rear layer and said front layer is between about one-fourth and about two inches, and wherein said multi-layer mitt is circular with a radius of between about six and about twelve inches.

10. Articles of play or sport, in accordance with claim 1, wherein selected portions of said mitt and said ball are phosphorescent.

11. Articles of play or sport, in accordance with claim 1 further comprising a strip of material having a multitude of irregular filamentary formations attached to an area at the perimeter of the front layer.

12. Articles of play or sport, in accordance with claim 1, wherein the rigid concave rear layer comprises a plurality of raised protrusions.

13. Articles of play or sport, in accordance with claim 12, wherein the raised protrusions are arranged in a pattern conforming to the inner edge of the retaining ring, but defining a sightly larger perimeter.

14. A multi-layer mitt for use by a participant in the game of catch which comprises: a rigid concave rear layer, a flexible layer, and a front layer having substantially all of its front surface defined by a multitude of irregular filamentary formations, the flexible layer occupying a surface area less than the surface area of the rear layer, the front layer being retained in place by a retaining ring having an inner edge which extends over a portion of the front layer to prevent the front layer from separating from the intermediate flexible layer, the inner edge having a plurality of teeth which contact a portion of the front layer.

15. A multi-layer mitt of claim 14, wherein the rear layer includes means for enabling in the participant to grasp the mitt.

16. A multi-layer mitt of claim 15, wherein the means for enabling the participant to grab the mitt comprise a strap.

17. A multi-layer mitt of claim 16, wherein the strap is adjustable.

* * * * *